United States Patent [19]

Janke

[11] 4,054,962

[45] Oct. 25, 1977

[54] WAX APPLICATOR FOR SKIS

[76] Inventor: Robert W. Janke, 820 Kewin St., Altoona, Wis. 54720

[21] Appl. No.: 645,736

[22] Filed: Jan. 5, 1976

[51] Int. Cl.[2] ..... A63C 11/08; B05C 17/10

[52] U.S. Cl. ..... 15/105; 15/104 S; 15/236 R; 428/455

[58] Field of Search ..... 15/104 R, 104 S, 218.1, 15/236 R, 105; 118/76; 428/455, 456

[56] References Cited

U.S. PATENT DOCUMENTS

| | | | |
|---|---|---|---|
| 320,530 | 6/1885 | Barstow | 15/236 R |
| 792,676 | 6/1905 | Staples | 15/236 R UX |
| 2,245,469 | 6/1941 | Ecklund et al. | 15/236 R X |
| 3,816,863 | 6/1974 | Thielemann | 15/236 R X |

FOREIGN PATENT DOCUMENTS

| | | | |
|---|---|---|---|
| 67,842 | 5/1944 | Norway | 15/104 R |
| 463,503 | 3/1950 | United Kingdom | 15/236 R |

*Primary Examiner*—Daniel Blum

*Attorney, Agent, or Firm*—Dorsey, Windhorst, Hannaford, Whitney & Halladay

[57] ABSTRACT

A wax applicator for skis comprising a block of generally abrasive material such as cork and a sheet of relatively hard material such as acrylic plastic secured face-to-face to serve as a wax spreader and smoother. The sheet extends past one edge of the block and the edge of the sheet extending past the block and an edge of the block are beveled such that they provide spaced beveled edges lying in a common plane.

1 Claim, 3 Drawing Figures

WAX APPLICATOR FOR SKIS

BACKGROUND AND SUMMARY OF THE INVENTION

The present invention relates generally to a wax applicator for skis, and more particularly, to a wax applicator for skis which includes means for applying the wax to the skis, means for smoothing the wax out on the skis and a means for scraping old wax from the skis. An applicator of this sort is particularly useful since it necessitates the use of only a single tool. In general, the device of the present invention includes a relatively rectangular block portion constructed of a generally abrasive material such as cork (either natural or synthetic) and a sheet of relatively hard material such as acrylic plastic. The block of cork and the sheet of acrylic plastic are secured face-to-face with each other by an epoxy or other glue or any other suitable means such that a portion of the acrylic sheet extends beyond one edge of the block of abrasive material. The edge of the acrylic sheet extending beyond the abrasive material block and the corner of the abrasive block opposite the face to which the acrylic sheet is secured and to the side of the block from which the acrylic sheet extends, are both beveled such that their beveled edges lie in a common plane.

Accordingly, it is an object of the present invention to provide a wax applicator for skis having an abrasive block portion such as cork secured face-to-face to a sheet of a relatively hard material such as acrylic plastic, with a portion of the sheet extending past the edge of the block and with each having a beveled edge lying substantially in the same plane. The abrasive block in combination with the acrylic plastic sheet is utilized to apply the wax to the skis, spread it out and to remove used wax when desired.

DESCRIPTION OF THE PREFERRED EMBODIMENT

Figure 1:
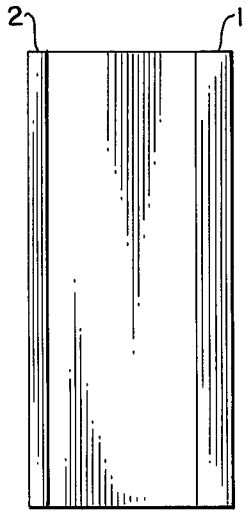
FIG. 1 is a top view of the wax applicator of the present invention.

The disclosed device creates a more efficient tool for applying wax to skis. By using the beveled edges of both the block of cork, reference numeral 2, and the acrylic plastic sheet, reference numeral 1, which are in the same plane, the necessary amount of abrasion produced by the cork to soften and spread the wax and the smoothing abilities of the acrylic plastic sheet are obtained. It is this feature which gives the device of the present invention distinct advantages over the prior art.

The object of this application is to apply wax to skis equally to the total surface area with the least amount of effort. Simply put the wax on the ski base and smooth out equally over the total surface area by applying equal pressure to the base while you are smoothing by using the cork edge 4 coincidentally with the spaced acrylic plastic edge 3.

Figure 2:
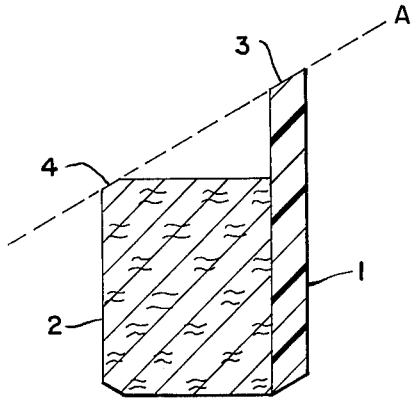
FIG. 2 is a cross sectional view of the wax applicator of the present invention.
Figure 3:
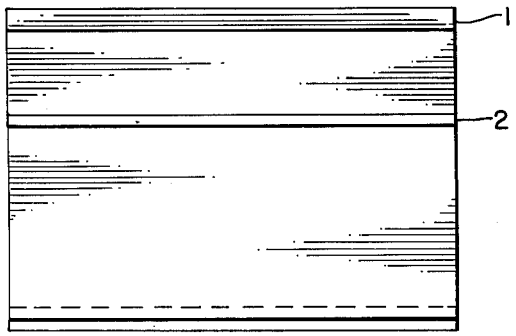
FIG. 3 is a side view of the wax applicator of the present invention.

The beveled edge 3 in FIGS. 1, 2 and 3 is at the same angle as the beveled edge 4. Thus, the line "A" represents a common plane to both beveled edges 3 and 4. This enables the user to use both of the beveled surfaces 3 and 4 simultaneously or coincidentally.

Although the description of the preferred embodiment has been quite specific, it is contemplated that various modifications could be made to the present invention without deviating from the spirit thereof. Accordingly, it is intended that the scope of the present invention be dictated by the appended claim rather than by the description of the preferred embodiment.

I claim:

1. A wax applicator for skis comprised of a block of cork and a sheet of relatively hard material such as an acrylic plastic secured face-to-face, the sheet extending beyond one side of the block, the edge of the projecting portion of the sheet and an edge of the said one side of the block being beveled to provide spaced flat surfaces lying in a common plane, the beveled cork edge serving to spread the wax and the beveled edge of the relatively hard material serving to smoothen the same.

* * * * *